US010990064B1

(12) United States Patent
Weber

(10) Patent No.: US 10,990,064 B1
(45) Date of Patent: Apr. 27, 2021

(54) PRESIDENTIAL PODIUM CLOCK

(71) Applicant: Ronald Weber, San Ysidro, CA (US)

(72) Inventor: Ronald Weber, San Ysidro, CA (US)

( * ) Notice: Subject to any disclaimer, the term of this patent is extended or adjusted under 35 U.S.C. 154(b) by 0 days.

(21) Appl. No.: 16/845,008

(22) Filed: Apr. 9, 2020

(51) Int. Cl.
*G04B 47/04* (2006.01)

(52) U.S. Cl.
CPC ..... *G04B 47/044* (2013.01)

(58) Field of Classification Search
CPC ..... G04B 47/04; G04B 47/044
See application file for complete search history.

(56) References Cited

U.S. PATENT DOCUMENTS 4,098,068 A 7/1978 Masuyama
4,482,253 A * 11/1984 Golobic ..... B65G 33/26 366/147
D295,384 S * 4/1988 Apker ..... D10/11
4,742,500 A * 5/1988 Luce ..... A63H 3/003 368/10
D391,173 S * 2/1998 Wang ..... D10/11
D407,023 S * 3/1999 Kuo ..... D10/29
6,326,883 B1 * 12/2001 Whitehead ..... G04F 1/005 340/309.3
D671,844 S 12/2012 Wright
2003/0235118 A1 * 12/2003 Lai ..... G04B 25/06 368/223

* cited by examiner

*Primary Examiner* — Sean Kayes

(57) ABSTRACT

An illustrated view of an exemplary clock directed at a political figure. The clock is useful for providing a current time. The clock is further useful for providing a listener with a recorded speech for the purpose of comedy. The clock is also useful for providing a figure, such as a current President, such as President Trump, for deriving a comedic effect.

10 Claims, 2 Drawing Sheets

PRESIDENTIAL PODIUM CLOCK

FIELD OF THE INVENTION

This invention relates to clocks. More particularly, it relates to clocks with podium bases.

BACKGROUND

A dock is a device used to measure, keep, and indicate time. The dock is one of the oldest human inventions, meeting the need to measure intervals of time shorter than the natural units: the day, the lunar month, and the year. Devices operating on several physical processes have been used over the millennia.

Some predecessors to the modern clock may be considered as "docks" that are based on movement in nature: a sundial shows the time by displaying the position of a shadow on a flat surface. There is a range of duration timers, a well-known example being the hourglass. Water clocks, along with the sundials, are possibly the oldest time-measuring instruments. A major advancement occurred with the invention of the verge escapement, which made possible the first mechanical clocks around 1300 in Europe, which kept time with oscillating timekeepers like balance wheels.

Traditionally in horology, the study of timekeeping, the term clock was used for a striking clock, while a clock that did not strike the hours audibly was called a timepiece. In general usage today, a "clock" refers to any device for measuring and displaying the time. Watches and other timepieces that can be carried on one's person are often distinguished from clocks. Spring-driven clocks appeared during the 15th century. During the 15th and 16th centuries, clockmaking flourished. The next development in accuracy occurred after 1656 with the invention of the pendulum clock by Christiaan Huygens. A major stimulus to improving the accuracy and reliability of clocks was the importance of precise timekeeping for navigation. The electric clock was patented in 1840. The development of electronics in the 20th century led to clocks with no clockwork parts at all.

The timekeeping element in every modern clock is a harmonic oscillator, a physical object (resonator) that vibrates or oscillates at a particular frequency. This object can be a pendulum, a tuning fork, a quartz crystal, or the vibration of electrons in atoms as they emit microwaves.

Clocks have different ways of displaying the time. Analog clocks indicate time with a traditional clock face, with moving hands. Digital clocks display a numeric representation of time. Two numbering systems are in use; 24-hour time notation and 12-hour notation. Most digital clocks use electronic mechanisms and LCD, LED, or VFD displays. For the blind and use-over telephones, speaking clocks state the time audibly in words. There are also clocks for the blind that have displays that can be read by touch.

Traditionally, clocks have been a similar style and are used to tell time, provide an alarm to a preset time, and combined with radios for alarming or listening, etc. Clocks can also be used to be ornamental, though the ornamental clocks have not carried a message of the times or a comment on the current political climate. Clocks do not reflect a current event or a comment on the current event.

Accordingly, in light of the foregoing, there is a desire for a clock that has a political statement on the current political climate or to directly reflect an opinion of a President or other lawmaker. Further, there is a desire for the clock to have a podium, such as that used for speeches and the like.

DETAILED DESCRIPTION

Figure 1A:
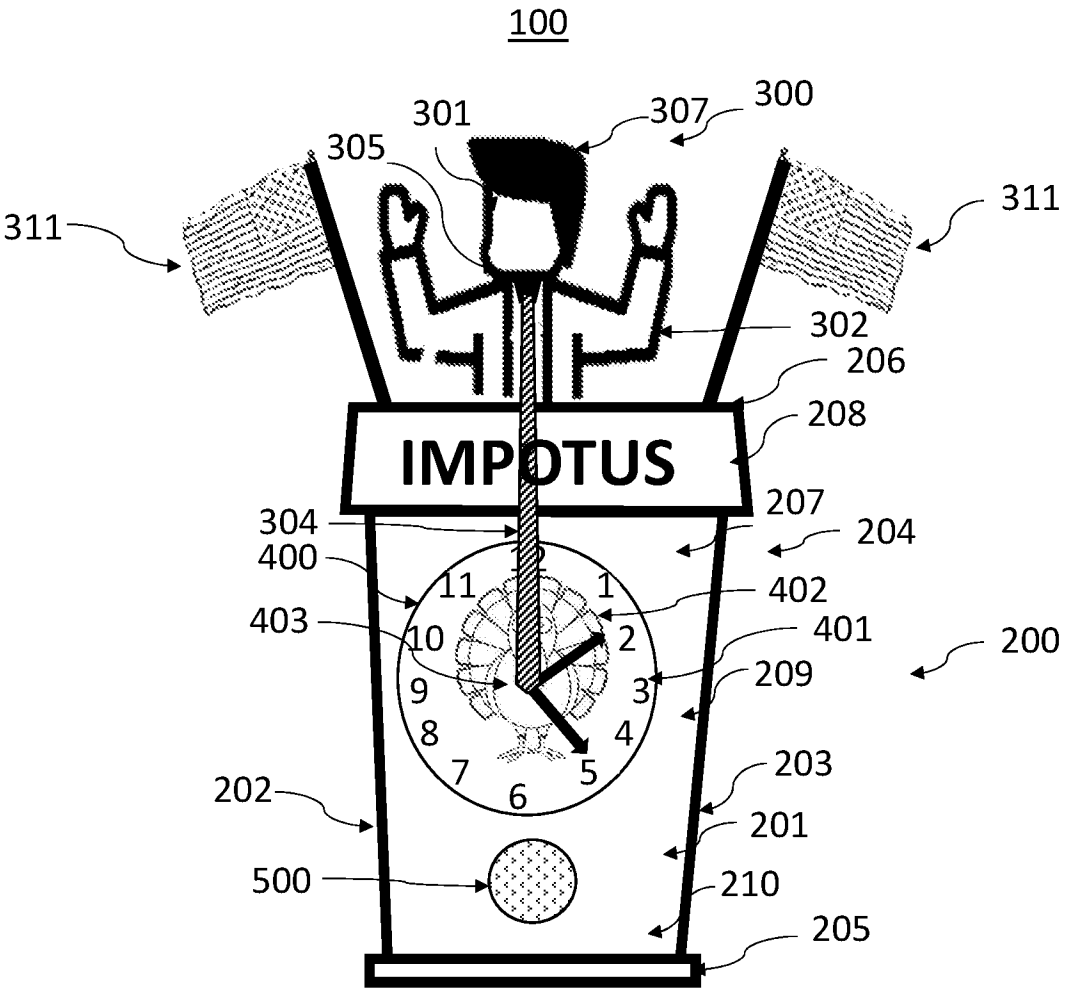
FIG. 1A is an illustrated view of an exemplary clock.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1A, is an illustrated view of an exemplary clock 100 directed at a political figure. The clock 100 is useful for providing a current time. The clock 100 is further useful for providing a listener with a recorded speech for the purpose of comedy. The clock 100 is also useful for providing a figure, such as a current President, such as President Trump, for deriving a comedic effect.

The clock 100 has a base 200, a FIG. 300, a clock face 400 and a speaker 500. The base 200 is preferably configured to resemble a podium shape, however other shapes are hereby contemplated. The base 200 has a front 201, a plurality of sides 202, 203, a back 204, a bottom 205 and a top 206. The bottom 205 of the base 200 is preferably flat such that it is stable when standing on a table, floor, etc.

The front 206 of the base 200 of the clock 100 has an upper end 207, a podium plate 208, a middle portion 209 and a bottom end 210. The podium plate 208 of the front 206 of the base 200 preferably has an inscription such as "IMPOTUS" reflecting on the acronym for "President of the United States", etc.

The clock face 400 has a plurality of numbers 401 and an insignia 402. The clock face 400 is preferably configured to be on an upper end 207 of the middle portion 209 of the front 200 of the clock 100. The insignia 402 is preferably configured to resemble a Presidential seal with a comedic sense based on the FIG. 300 of the clock 100. In the example shown in FIG. 1A, the insignia 402 is a turkey figure, however other figures are hereby contemplated.

The speaker 500 is configured to be substantially near the bottom end 210 of the middle portion 209 of the front 206 of the base 200 of the clock 100. The speaker 500 is useful for allowing a predetermined sound, such as a pre-recorded speech, soundtrack, music, etc. to be emitted from the clock 100 as desired. The sound is preferably a comedic rendering of a soundbite however other types of sounds are hereby contemplated.

The figure 300 is preferably coupled to the top 206 of the base 200. The figure 300 is preferably a political figure, such as the President of the United States, however other types of figures are hereby contemplated, including, but not limited to, sports athletes, entertainers, etc.

The figure 300 has a head 301 and a body 302. The body 302 preferably is configured to have a tie 304. The tie 304 extends from a neck 305 of the FIG. 300 to a middle 403 of the clock face 400. The tie 304 is preferably red in color, however other colors are hereby contemplated, including, but not limited to, blue, black, white, checkered, etc.

The head 301 has a face 306 and hair 307. The face 306 preferably resembles the person depicted for the sound of the clock 100. The hair 307, likewise, resembles the hairdo of the person being depicted in the FIG. 300 of the clock 100.

Further, extending from the top 206 of the base 200 are one or more flags 311. The flags 311 are preferably in reference to a country, such as the United States, etc. The flags 311 are consistent with the FIG. 300 depicted for the clock 100.

Figure 1B:
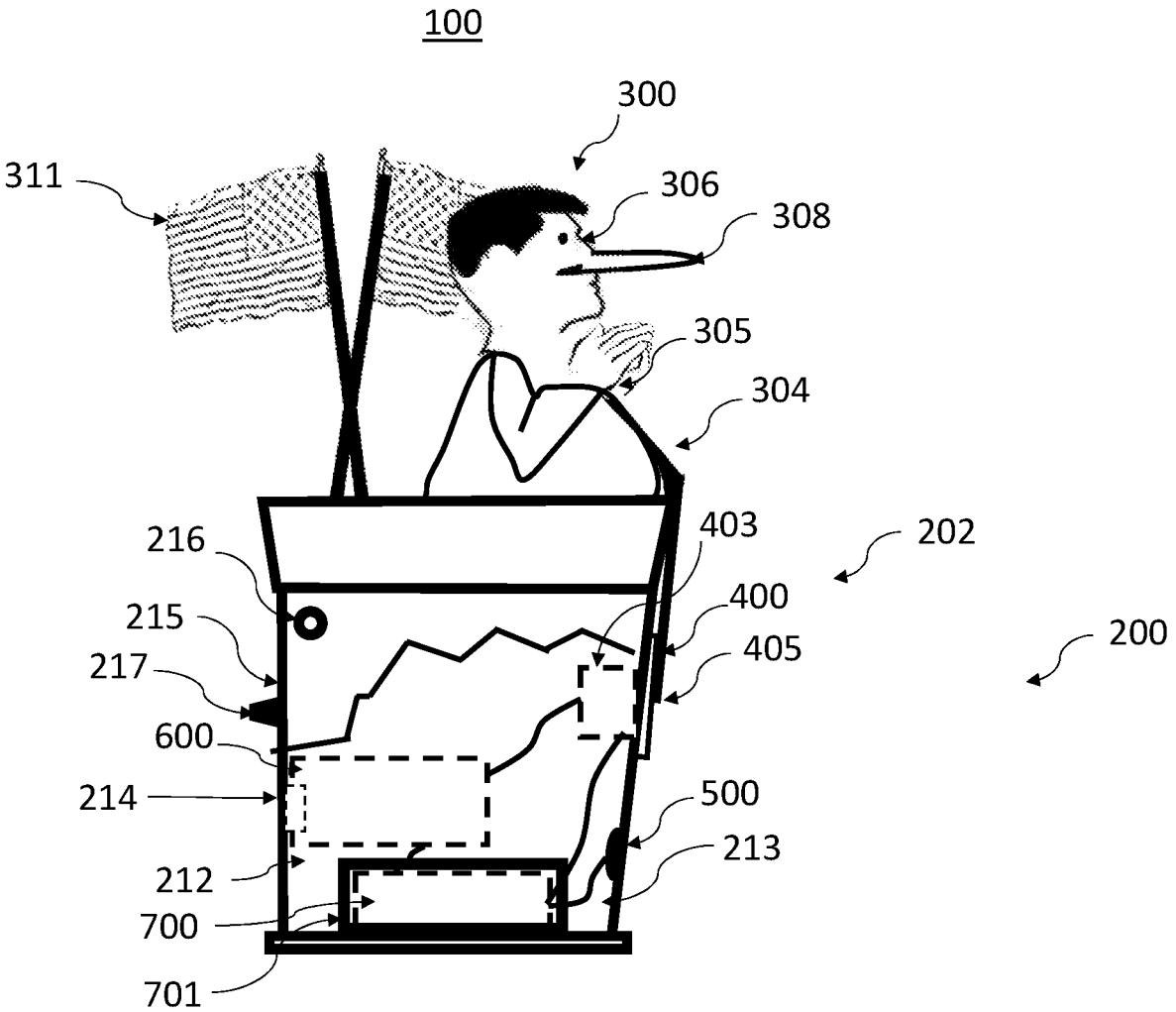
FIG. 1B is an illustrated view from a side of the exemplary clock shown in FIG. 1A.

Moving now to FIG. 1B, an illustrated view from a side 202 of the exemplary clock 100 shown in FIG. 1A showing features of the clock 100.

The side 202 has the base 200 and an interior 212 and an outside 213. The interior 212 of the base 200 has a computing device 600, and an interior 403 of the clock face 400. A back 215 of the outside 213 of the base 200 has a slot 214. The slot 214 preferably is a "SD Card" slot, where the memory device, also known as the SD Card, contains recordings to be played through the speaker 500. The slot 214 is useful for insertion of the SD Card into the computing device 600.

A button 216 is coupled to the base 200. The button 216 actuates the SD card and exacts recordings contain on the SD Card. The button 216 may also be useful in deactivating sounds from being emitted from the speaker 500. The button 216 is communicatively coupled to the computing device 600. A switch 217, preferably a toggle switch, is coupled to the back 215 of the base 200. The switch 217 is configured to enable/disable the playing of the recordings on the SD Card slot 214 without affecting the operation of the clock face 400.

The tie 304 extends from a neck 305 of the FIG. 300 to a middle 403 of the clock face 400.

A battery 700 is configured to be in the interior 212 of the base 200. The battery 700 is preferably a rechargeable battery, however other types of batteries are hereby contemplated, including, but not limited to, disposable battery, NiCad, 9-volt, AAA, AA, etc. The battery 700 is electrically coupled to the computing device 600, the speaker 500 and the clock face 400. A door 701 is coupled to the base 200. The door 701 allows for access to the interior 212 of the base 200, for example, to replace the battery 700.

The computing device 600 is communicatively coupled to the speaker 500, the FIG. 300 and the clock face 400. The computing device 600 controls a time displayed on the clock face 400 and further controls the sound to be emitted from the speaker 500. The sounds may be emitted from the speaker 500 at predetermined times or in predetermined intervals.

When the computing device 600 determines a sound to be emitted from the speaker 500, the computing device 600 may direct a change in the facial features of the FIG. 300. In the example, as the sound of a speech is played indicating a stretching of the truth or a lie, a nose 308 on the face 306 of the FIG. 300 is extended in a Pinocchio-like fashion.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A clock for deriving comedic relief from a public person, the clock comprising:

a base, the base comprising:

a front, a plurality of sides, a top, a bottom and a back, wherein the front having an upper end, a bottom end, a podium plate and a middle portion;

a clock face, the clock face being configured significantly near the upper end of the middle portion of the front;

a speaker, the speaker being coupled to significantly near the bottom end of the middle portion of the front;

an insignia, the insignia being on the podium plate of the front;

an interior and an outside;

a figure, the figure having a face, a body and a hair, the figure being coupled to the top of the base;

one or more flags, the one or more flags being coupled to the top of the base;

a computing device, the computing device being coupled to the interior of the base, wherein the computing device being communicatively coupled to the clock face, and wherein the computing device being communicatively coupled to the speaker, and wherein the computing device being coupled to the figure;

a battery, the battery being coupled on the interior of the base, wherein the battery being electrically coupled to the computing device, wherein the battery being electrically coupled to the speaker, and wherein the battery being electrically coupled to the clock face; and a slot, the slot being configured on the exterior of the side of the base, wherein the slot being coupled to the computing device, wherein the slot being configured to receive a memory device.

2. The clock of claim 1, wherein the memory device being an SD card.

3. The clock of claim 1, wherein the face of the figure having a nose.

4. The clock of claim 1, the figure further comprising a tie, wherein the tie being extended to a middle of the clock face.

5. The clock of claim 1, wherein the memory device having a recording.

6. The clock of claim 5, wherein when a predetermined time being met, the recording of the memory device being emitted by the computing device to the speaker.

7. The clock of claim 6, wherein the soundbite being emitted by the computing device to the speaker, the computing device sending a command to extend a nose of the face of the figure.

8. The clock of claim 5, further comprising:

a button, the button being coupled to a back of the base, wherein when the button being actuated the recording being played through the speaker, and wherein the button being actuated to choose a recording to emit through the speaker.

9. The clock of claim 1, wherein the insignia having a take-off of the President of the United States being "IMPOTUS".

10. The clock of claim 1, the clock further comprising: a switch, the switch being coupled to a back of the base, wherein when the switch being actuated, the recording will be configured to be off, thereby not playing the recording.

* * * * *